US006669080B2

(12) United States Patent
Ong

(10) Patent No.: US 6,669,080 B2
(45) **Date of Patent: *Dec. 30, 2003**

(54) COMBINED FILE POCKET AND EXPANDING FILE

(76) Inventor: Bon S. Ong, Box 4247, Torrance, CA (US) 90510

( * ) Notice: Subject to any disclaimer, the term of this patent is extended or adjusted under 35 U.S.C. 154(b) by 0 days.

This patent is subject to a terminal disclaimer.

(21) Appl. No.: 10/098,119

(22) Filed: Mar. 15, 2002

(65) Prior Publication Data

US 2003/0183679 A1 Oct. 2, 2003

(51) Int. Cl.[7] ..... B65D 27/00
(52) U.S. Cl. ..... 229/67.3; 229/67.4; 150/113
(58) Field of Search ..... 229/67.1, 67.3, 229/67.4, 72; 150/113; 190/110

(56) References Cited

U.S. PATENT DOCUMENTS

| | | | | | |
|---|---|---|---|---|---|
| 325,676 | A | | 9/1885 | Jenkins | |
| 975,792 | A | | 11/1910 | Pittman | |
| 1,455,419 | A | | 5/1923 | Ahlquist | |
| 1,940,900 | A | * | 12/1933 | Barnard | 190/110 |
| 2,151,469 | A | * | 3/1939 | Hochthel | 229/69 |
| 2,333,798 | A | | 3/1943 | Kner | |
| 2,316,328 | A | * | 4/1943 | Guenther et al. | 190/124 |
| 2,612,199 | A | * | 9/1952 | Schocket | 150/112 |
| 2,893,457 | A | * | 7/1959 | Wilson | 29/254 |
| 4,262,838 | A | | 4/1981 | Mackensie | |
| 4,274,577 | A | | 6/1981 | Walsh, Jr. | |
| 5,271,502 | A | | 12/1993 | Chang | |
| 5,664,724 | A | | 9/1997 | Ho | |
| 6,502,742 | B1 | * | 1/2003 | Su | 229/67.3 |

* cited by examiner

*Primary Examiner*—Jes F. Pascua
(74) *Attorney, Agent, or Firm*—Charles H. Thomas

(57) ABSTRACT

A portable document storage device is formed of a filing pouch having a collapsible pocket and a foldable flap extending from its back cover, and an expandable filing case. The filing case is partitioned by a plurality of indexed section dividers that divide the filing case into a plurality of pockets to receive papers in an orderly manner. Mutually engageable releaseable fasteners are located on the back cover of the filing case and on the front cover of the filing pouch. When the releaseable fasteners are engaged the filing case can be carried with the filing pouch and is enveloped by the foldable cover of the filing pouch. Alternatively, the fasteners may be released from each other so that the filing case may be completely or partially detached from the filing pouch.

14 Claims, 9 Drawing Sheets

COMBINED FILE POCKET AND EXPANDING FILE

BACKGROUND OF THE INVENTION

1. Field of the Invention

The present invention relates to a filing wallet assembly that includes a filing pouch and a filing case that has an expanding file which may be utilized together or separately from each other. The filing case has releaseable fasteners on its back cover that are detachable from corresponding fasteners on the front cover of the filing pouch. The closure flap of the filing pouch encloses the filing case within the confines of the filing pouch when the filing case is attached to the filing pouch.

2. Description of the Prior Art

At present, portable filing wallets are designed to accommodate documents and other small articles of different sizes. While some articles and papers, for example, thick reports, are conveniently stored in a relatively large pouch, in other cases it is more useful to separate different papers with divider sheets. The use of divider sheets provides a means of segregating related papers so that they may be accessed conveniently. Such divider sheets may be provided within an expandable filing case to greatly enhance the accessibility and ease of viewing the documents in the file.

SUMMARY OF THE INVENTION

The present invention provides a convenient system for storing and transporting different types of documents in a single wallet structure having different filing systems. Specifically, and briefly stated, the present invention is the combination of a filing pouch having a foldable and enveloping flap, and an expandable filing case subdivided into a plurality of file pockets by divider sheets.

One primary object of the present invention is to provide a combination structure suitable for carrying both thick, bulky documents, and also documents that are much thinner and which are sorted into indexed filing pockets so that they may be found easily.

A further object of the invention is to provide such a combination document filing and transporting device with an expandable folder access system so that documents in the filing case are readily visible when the filing case is opened. The sides of the filing case are constructed with pleated, accordion folds so that as the filing case front cover is drawn away from the top of the rear filing case cover, the contents of the filing case between the indexed, tabbed dividers in the individual pockets are readily visible.

A further object of the invention is to provide such a combination with releaseable fasteners, so that the filing case may be wholly or partially separated from the filing pouch.

The wallet structure may be constructed in two versions. In one embodiment the filing case is completely detachable from the pouch so that the pouch and filing case may be utilized separately. However, the front of the pouch and the back of the filing case are provided with releaseable fasteners so that the pouch and expandable filing case may be releaseably coupled together. When joined in this fashion the foldable flap of the pouch folds over the top of the filing case, as well as the top of the pouch. The pouch and the filing case may thereby be conveniently carried together in a compact and securely closed manner.

In an alternative embodiment, the top of the back of the filing case is permanently secured to the top of the front of the filing pouch. This construction keeps the two filing devices together and prevents them from becoming separated and disassociated one from another.

In one broad aspect the present invention may be considered to be the combination of a filing wallet and an expandable filing case. The filing wallet has a pouch front cover and a pouch back cover both having a top and a bottom. The filing wallet also includes a pouch folding flap joined to the top of the pouch back cover in articulated fashion. In this way the pouch folding flap is foldable over the top of the pouch front cover and unfoldable to expose the top of the pouch front cover.

A pair of pouch side panels are provided each having a top and a bottom and each being attached to the pouch front and pouch back covers from the tops to the bottoms thereof. The filing wallet also has a pouch bottom panel extending transversely between the pouch side panels and between the pouch front and back covers. The filing wallet thereby forms a pouch file pocket between the pouch front and pouch back covers, the pair of pouch side panels and the pouch bottom panel.

The expandable filing case has a filing case front cover and a filing case back cover, both having a top and a bottom. The filing case also has a plurality of filing case file section dividers having opposing mutually parallel, upper and lower filing case divider edges and opposing, mutually parallel side filing case divider edges oriented perpendicular to the upper and lower filing case divider edges.

The filing case divider side edges are coupled to the filing case front and back covers with a plurality of accordion folded pleated connections. The bottom edges of the filing case file section dividers are closed, thereby forming a plurality of filing case pockets between the filing case file section dividers and the filing case front and filing case back covers. The filing case back cover is connected to the pouch front cover. The filing pouch foldable flap is foldable over the filing case to both close the pouch file pocket and envelop the filing case between the filing pouch foldable flap and the filing pouch front cover.

Preferably, the filing case includes a single, stiff sheet of covering material that is folded to delineate the filing case front and back covers and which is folded further to delineate a filing case bottom panel between the filing case front and back covers. The filing case bottom panel thereby forms a closure member beneath the filing case file section dividers.

Releaseable fastening members are preferably provided and include mutually engageable first and second fastening member elements for connecting the filing case back cover to the pouch front cover. The first fastening member elements are permanently secured to the filing case back cover. The second fastening member elements are permanently secured to the pouch front cover. The mutually engageable first and second fastening member elements are preferably comprised of flexible fabric hook and loop fastening members.

In one embodiment the pouch front cover and the filing case back cover are permanently secured together across their tops. The releaseable fasteners are located at the bottoms of the pouch and the filing case. The first fastening elements are permanently secured to the bottom of the filing case back cover while the second fastening elements are permanently secured to the bottom of the pouch front cover for registration and engagement with the first fastening elements. The bottoms of the pouch and the filing case may thereby be pulled free from each other while the filing case remains secured to the filing pouch by the permanent attachment at the top of the back of the filing case and the top of the front of the filing pouch.

In another embodiment of the invention the first and second mutually engageable and releaseable fastening elements are located at the top and bottom of both the pouch front cover and the filing case back cover and there is no permanent connection between the pouch front cover and the filing case back cover. In this embodiment the filing pouch and filing case may be completely detached from each other by disengagement of all of the first and second releaseable fastening elements. Both embodiments provide the capability of attaching the pouch and expandable file together and transporting them as a unit.

The filing case is preferably configured to have expandible pockets created by side panels folded from top to bottom with accordion folds. The user is thus able to compactly collapse documents within the filing case for ease and convenience in transporting a plurality of filed documents. When the user wishes to withdraw the documents from the filing case once the pouch cover flap has been opened, the expandible sides of the expandable filing case allows the top openings of the filing case pockets to be spread wide, so that the user can easily find particular papers or other articles within the portable filing device.

The filing pouch employed in the combination of the invention may be formed having a back cover, a pair of opposing side panels, a bottom panel, a front cover, and a closure flap. The back cover and closure flap are formed from a common sheet of stiff, but flexible protective material, such as heavy gauge polypropylene or polyethylene plastic. One or more folds delineate the back cover from the folding flap of the filing pouch. The filing pouch may be closed by folding over the closure flap from the top of the pouch back cover to cover the pouch front cover. Some closure device, such as an elastic loop attached to the folding flap near its free edge may be utilized to hold the filing pouch closed shut.

Releaseable fasteners, such as flexible hook and loop fastening pads sold under the registered trademark Velcro®, or metal snap fastening devices, are provided to allow the filing pouch to be attached to the filing case. The detachable fasteners on the back cover of the filing case are positioned for selective engagement with corresponding fastening members on the front cover of the filing pouch. In one embodiment of the invention the releaseable fasteners are the only form of connection between the filing pouch and the filing case. In this embodiment the releaseable fasteners allow the filing case and filing pouch to be united together in a fully detachable manner for ease of transport. Furthermore, the engageable attachment feature aids in preventing the expandable filing case from becoming lost or misplaced since it is attached to and encompassed within an enveloping structure, namely the pouch front cover and the foldable filing pouch flap that entraps the filing case within the enveloping confines of the filing pouch. Nevertheless, the filing case may be completely detached and removed from the larger filing wallet.

In a different embodiment of the invention the releaseable fasteners are located only at the bottom of the back of the filing case and the front of the filing pouch, and the top of the back of the filing case is permanently secured to the top of the front of the filing pouch by a hinged connection. This arrangement prevents the filing case and filing pouch from becoming inadvertently separated.

In another broad aspect the invention may be considered to be a portable document storage device that includes: a portable file folder pouch formed of a pouch file base sheet upon which a pouch file back cover and a foldable pouch file flap are delineated. A pouch front cover is also provided and pouch side panels and a pouch bottom panel are disposed between the pouch front and back covers. The pouch side and bottom panels are joined to the pouch front and back covers and include an accordion folding or collapsible pleat throughout between the pouch front cover and the pouch back cover. This construction allows the pouch pocket formed between the pouch front and back covers to be collapsed or partially collapsed, depending upon the thickness of the documents stored therein.

The portable document storage device further includes a filing case formed of a case base sheet upon which a case back cover having upper and lower edges, a case bottom, and a case front cover having upper and lower edges are delineated. A plurality of filing case section dividers are provided. Each filing case section divider has opposing, mutually parallel, upper and lower filing case divider edges and opposing, mutually parallel side filing case divider edges oriented perpendicular to the upper and lower filing case divider edges. The filing case file section dividers are coupled to the filing case front and back covers with accordion folding pleated connections. The bottom edges of the filing case file section dividers are closed, thereby forming a plurality of filing case file pockets. These filing case file pockets are located between the filing case file section dividers and the filing case front and filing case back covers.

Detachable fasteners are provided on the pouch front cover and on the back filing case cover. These detachable fasteners releaseably join the portable file folder pouch and the filing case together.

The invention may be described with greater clarity and particularity with reference to the accompanying drawings.

DESCRIPTION OF THE EMBODIMENT

Figure 1:
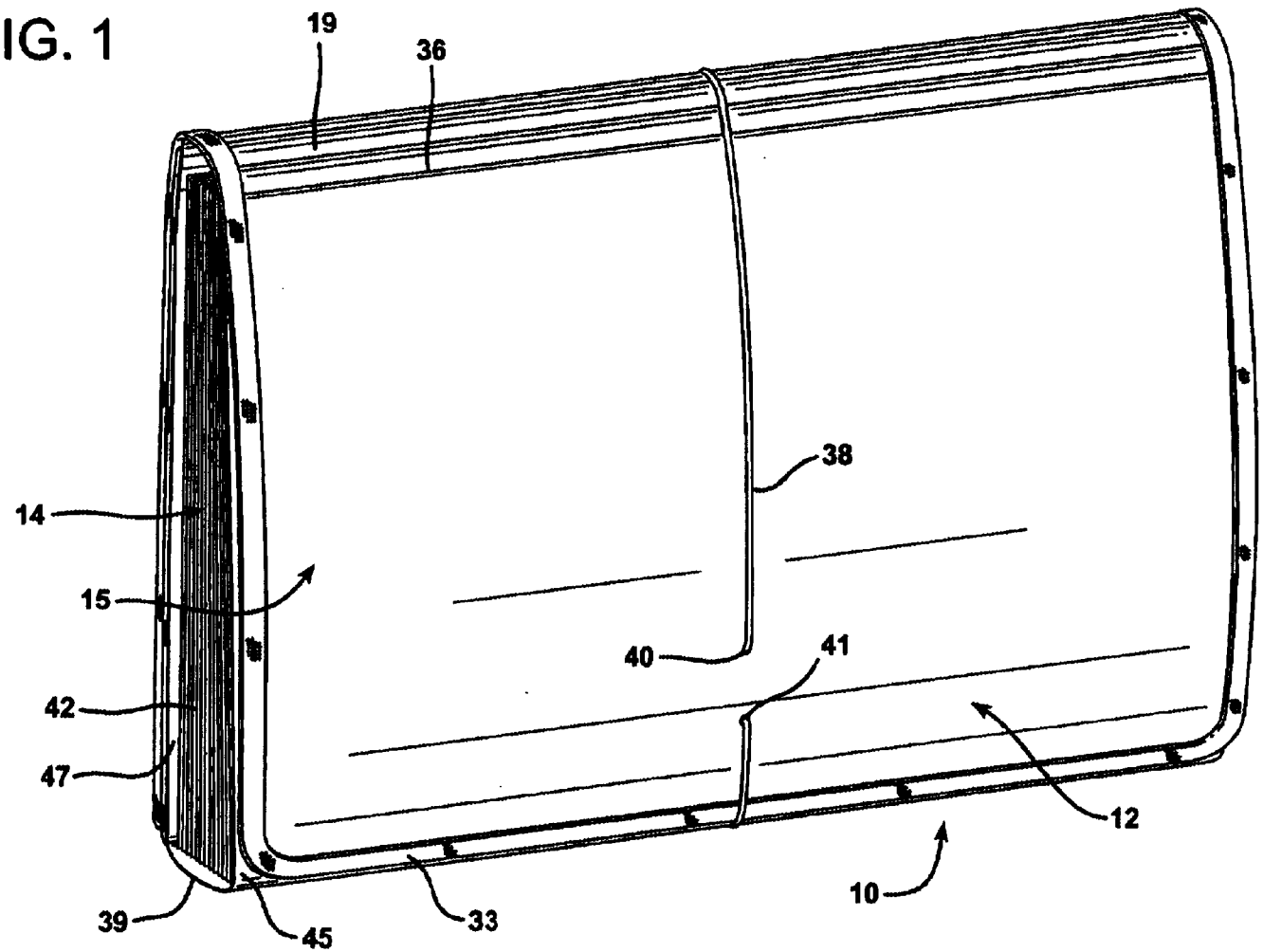
FIG. 1 is a perspective view of one preferred embodiment of a portable document storage device according to the invention, shown with the filing pouch cover flap of the filing pouch enveloping the filing case therewithin.
Figure 2:
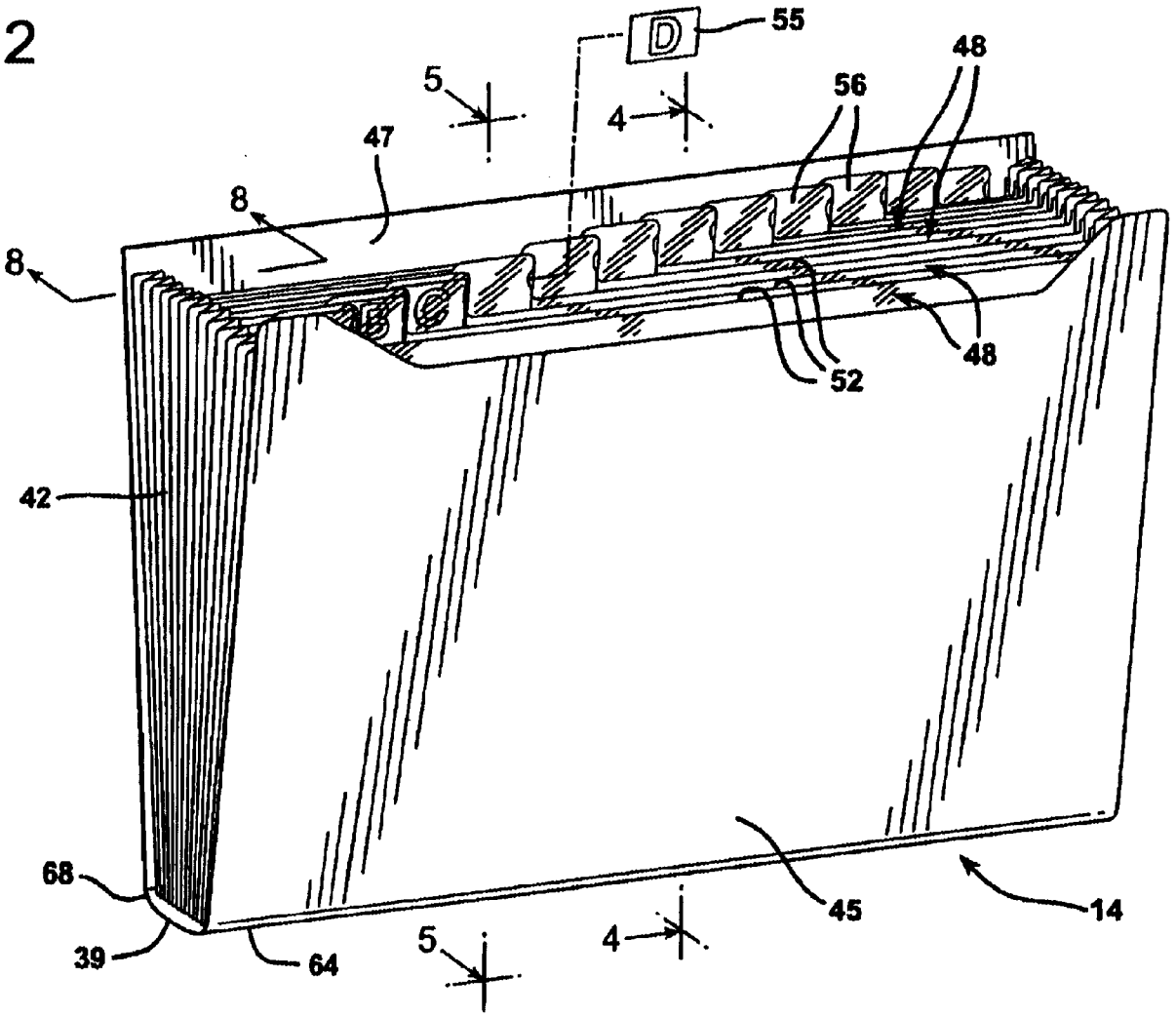
FIG. 2 is a perspective view of the filing case of the portable document storage device of the invention, shown in isolation.
Figure 3:
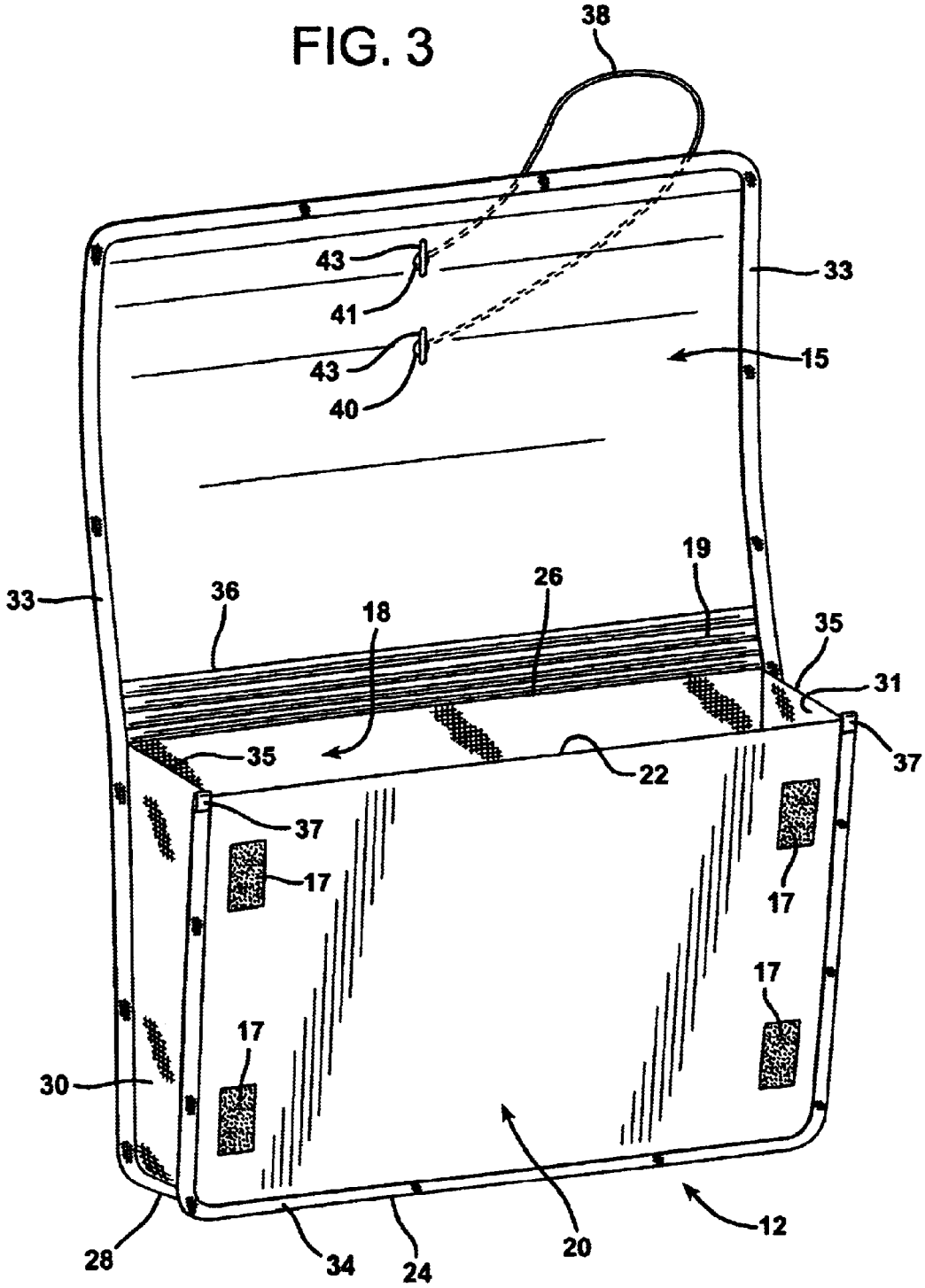
FIG. 3 is a perspective view of the filing pouch of the portable document storage device of the invention, shown in isolation.
Figure 4:
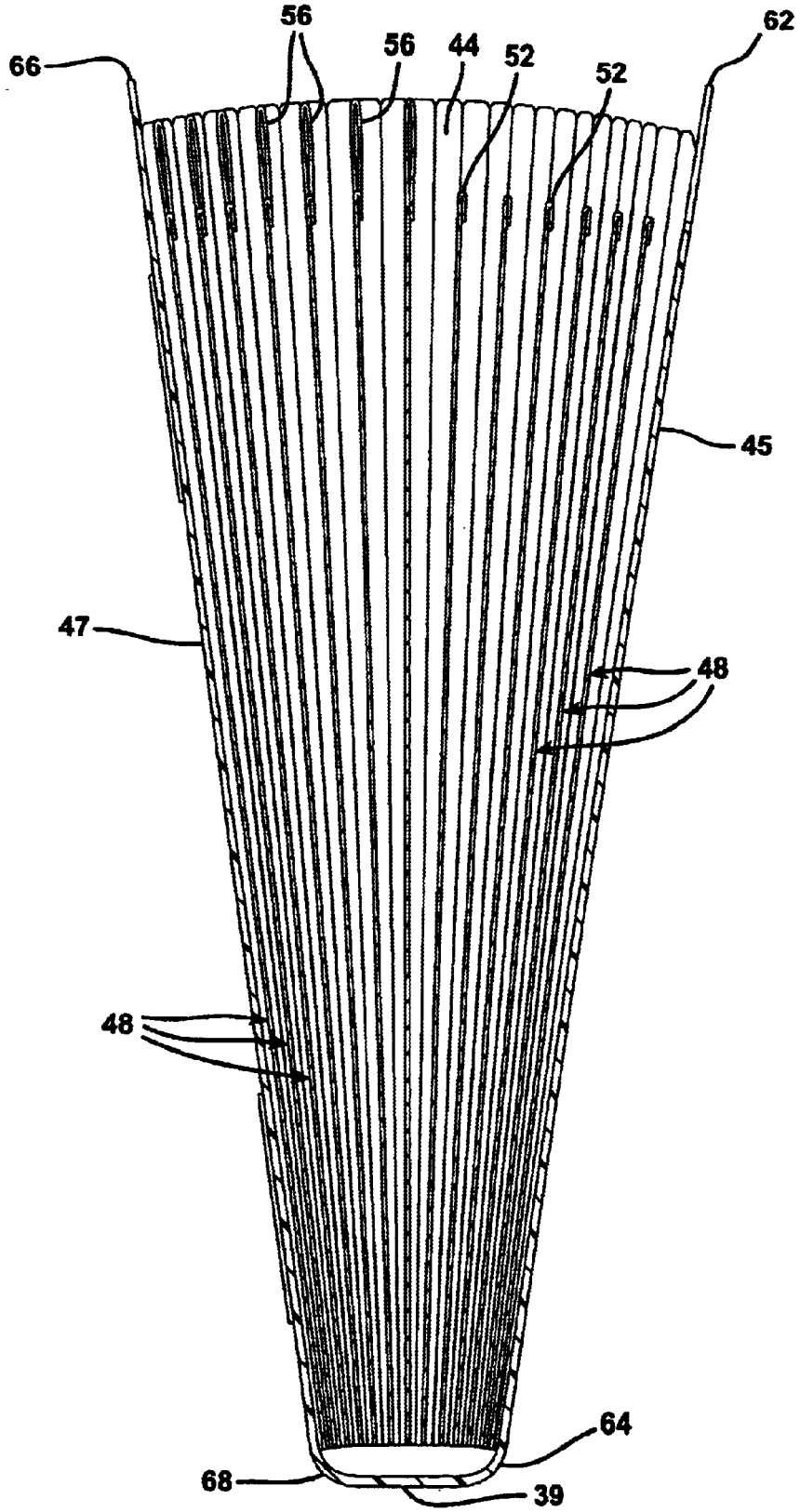
FIG. 4 is a side elevational sectional view of the filing case taken along the lines 4—4 of FIG. 2.
Figure 5:
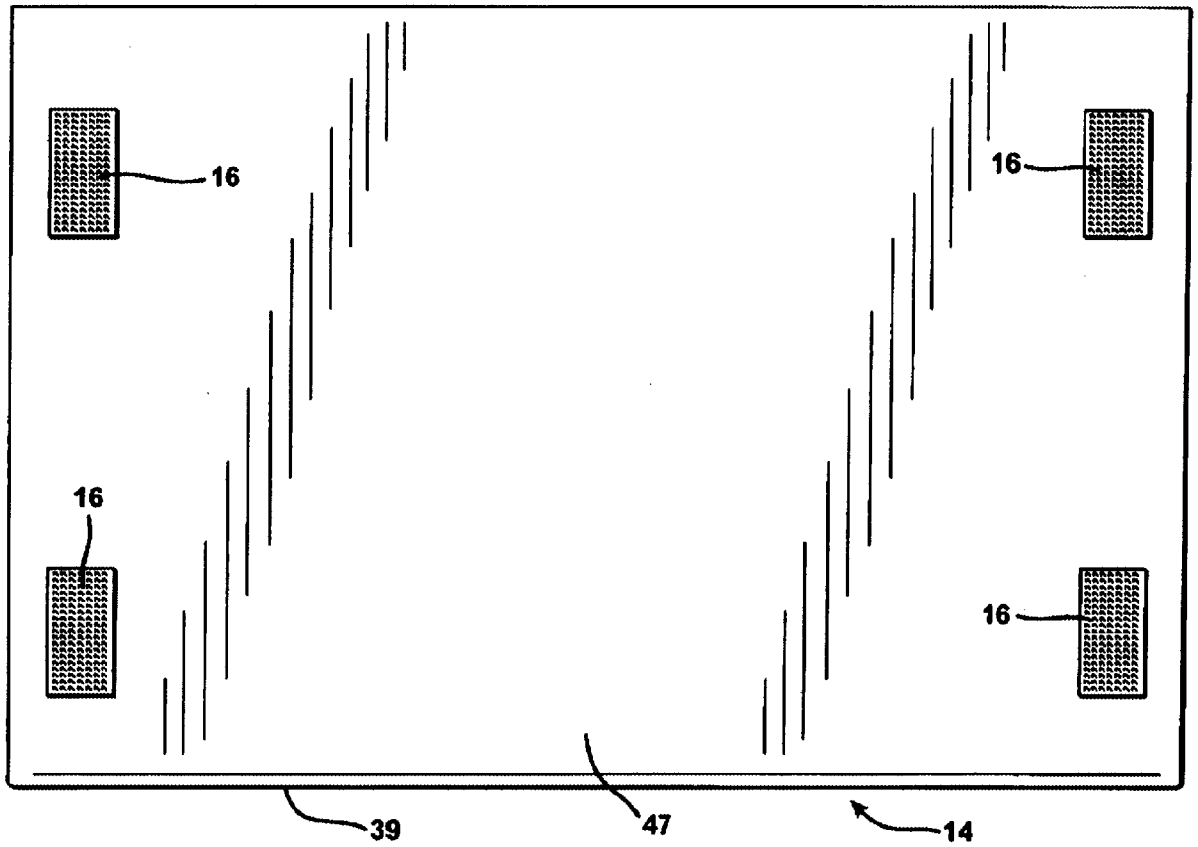
FIG. 5 is a rear elevational view of the filing case of the portable document storage device of the invention taken along the lines 5—5 in FIG. 2.
Figure 6:
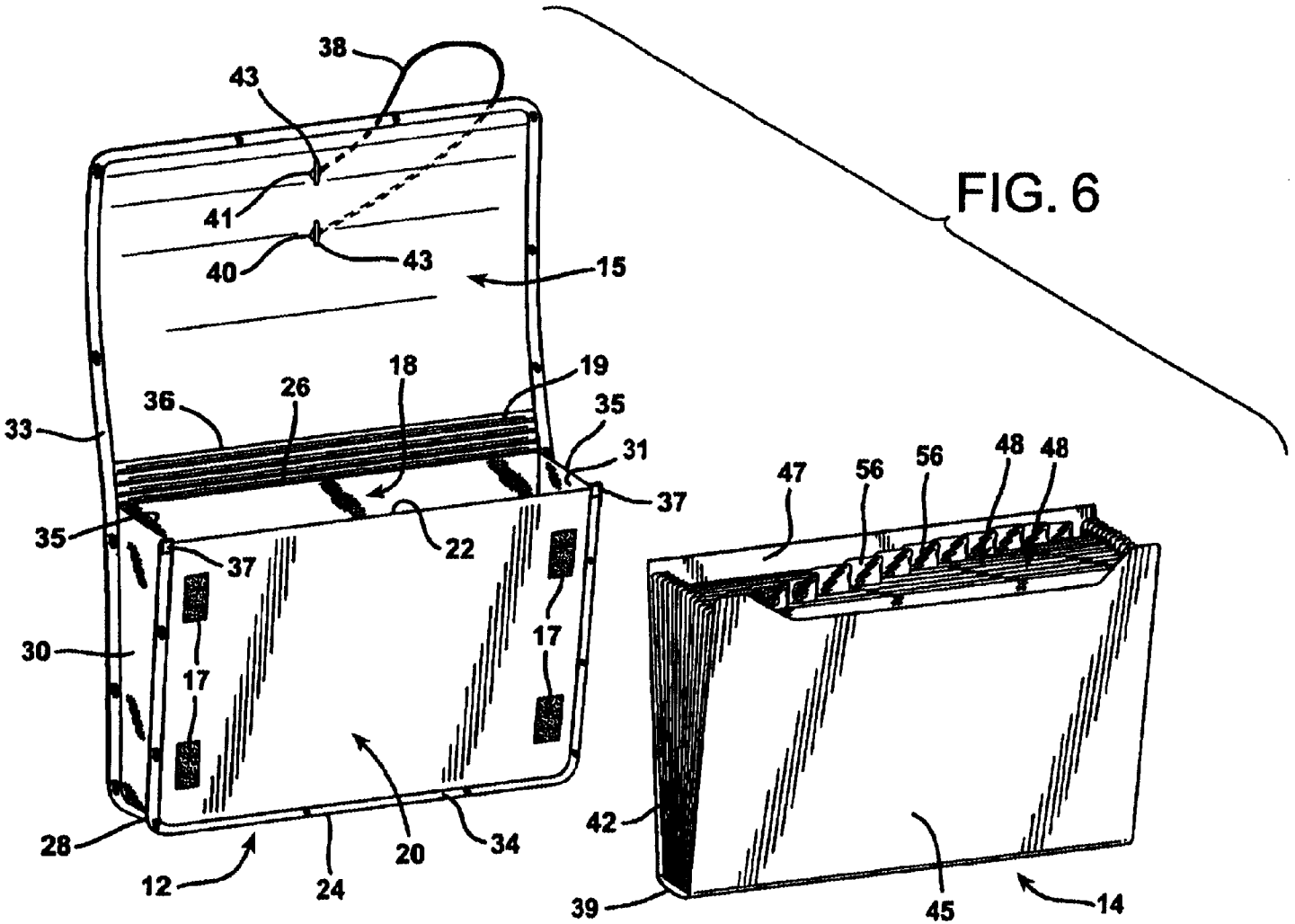
FIG. 6 is an exploded perspective view showing the manner of interconnection and separation of the filing pouch and filing case of the portable document storage device of the invention.

FIG. 1 illustrates a portable document storage device or wallet assembly 10 which, in fact, is the combination of a filing wallet or pouch 12, shown in FIGS. 1, 3, and 6, and a slightly smaller expandable filing case 14. This filing case 14 is hidden from view in FIG. 1 by the filing pouch closure flap 15, but is visible in FIGS. 2 and 6. As shown in FIGS. 4, 5, and 6, the expandable filing case 14 is detachably coupled to the filing pouch 12 by means of releaseably engageable fastener elements 16 and 17, which, in the embodiment shown, are flexible, mating hook and loop fabric fastening pads, such as those sold under the registered trademark Velcro®.

As best illustrated in FIGS. 3 and 6, the filing pouch 12 has a large, generally rectangular front cover 20 and a large, generally rectangular back cover 18, both having a top and a bottom. The top of the front cover 20 is indicated at 22 in FIGS. 3 and 6, while the bottom of the front cover 20 is indicated at 24. The top of the back cover 18 is indicated at 26, while the bottom of the back cover 18 is indicated at 28.

The filing pouch 12 has a folding closure flap 15 that is foldable over the top 22 of the front cover 20 as illustrated in FIGS. 1 and 3. In the embodiment of the portable storage device 10 illustrated, the filing pouch back cover 18 and the filing pouch folding flap 15 of the filing pouch 12 are both formed as parts of a single first base sheet of stiff, plastic material, such as polypropylene or polyethylene. This base sheet is folded to delineate the filing pouch back cover 18 and the filing pouch closure flap 15, and also an articulated top panel 19 located between the pouch flap 15 and the pouch back cover 18. A fold at the top edge 26 of the back panel 18 delineates the back panel 18 from the top panel 19. An articulated fold at 36 delineates the top panel 19 from the closure flap 15. The top panel 19 has a series of articulated folds so as to better accommodate various thicknesses of documents within the filing pouch 12. The filing pouch front cover 20 is formed of a separate, second stiff, plastic base sheet of the same material that forms the pouch back cover 18, top panel 19, and foldable flap 15, and preferably having the same thickness as the first base sheet.

In the embodiments of the invention illustrated, a pair of mutually opposing side panels 30 and 31 and a bottom closure panel 32 are formed of a single strip of fabric that has opposing edge margins which contact the pouch front cover 20 and the pouch back cover 18. Each of the side panels 30 and 31 has a top edge 35 and a bottom where the folded fabric forms a transition to the transversely oriented bottom panel 32.

The fabric side panels 30 and 31 and the bottom panel 32 are permanently secured throughout their entire lengths to the pouch front cover 20 and the pouch back cover 18 by narrow, fabric edge margin reinforcing strips 33 and 34. The reinforcing strip 33 is folded over the mutually juxtaposed surfaces of the edge margins of the fabric forming the side panels 30 and 31 and the bottom panel 32 and the first plastic base sheet forming the pouch back cover 18, top panel 19, and foldable flap 15 at the back of the pouch 12. Stitching secures the reinforcing strip 33 to the first base sheet and to the fabric forming the side panels 30 and 31 and bottom panel 32. The reinforcing strip 33 extends around the entire generally rectangular perimeter of the first base sheet forming the pouch back panel 18, top panel 19, and closure flap 15. Similarly, the reinforcing fabric strip 34 is secured by stitching to the second base sheet forming the front pouch cover 20 and to the adjoining edge of the fabric strip forming the side panels 30 and 31 and the bottom panel 32 that is in contact with the back side of the front panel 20. Metal clips 37 at the top edge 22 of the front panel 20 anchor the ends of the reinforcing strip 34 thereto.

Together, the pouch front cover 20, the pouch back cover 18, the pouch side panels 30 and 31 and the pouch bottom panel 32 define therebetween a single large pouch wallet pocket. This pocket is of a size and configuration suitable for accommodating large bulky papers, such as voluminous reports, books, notebooks and ring binders. The pouch pocket is also suitable for carrying articles other than papers, such as sales specimens and even personal items. The filing wallet foldable flap 15 is foldable over the filing case 14 both to close the pouch file pocket and to envelop the filing case 14 between the filing wallet foldable flap 15 and the filing wallet front cover 20.

The folding flap 15 is provided with an elastic loop 38 that passes through openings 40 and 41 in the pouch closure flap 15. The ends up the elastic loop 38 are provided with metal end clips 43 on the inside surface of the foldable flap 15. The end clips 43 are too large to pass through the openings 40 and 41 in the closure flap 15. The elastic loop 38 can be stretched to envelope the entire structure of the portable document storage device 10 so that it can be transported in a very compact and secure manner, as illustrated in FIG. 1.

The expandable filing case 14 has a stiff, plastic filing case front cover 45 and a stiff, plastic back cover 47 with a filing case bottom panel 39 formed therebetween. The filing case front and back covers 45 and 47 and bottom panel 39 are formed by folding a single base sheet of stiff, heavy-duty plastic into a generally U-shaped configuration, as illustrated in FIG. 4. The filing case front cover 45 has a top, edge 62 and a bottom fold 64. The filing case back cover 47 has a top edge 66 and a bottom fold 68. The filing case front cover 45 is delineated from the bottom panel 39 by the bottom fold 64 while the filing case back cover 47 is delineated from the bottom panel 39 by the bottom fold 68. The filing case bottom panel 39 is thereby delineated on the same sheet of covering material as the filing case front cover 45 and the filing case back cover 47 between the two bottom fold 64 and 68.

The filing case 14 is provided with filing case side panel sheets 42 and 44, also formed of polypropylene or polyethylene plastic, but of a considerably thinner gauge than the plastic forming the covers thereof. The filing case side panel sheets 42 and 44 originally have a rectangular shape, but are folded back and forth along vertical folds in alternating directions to form a plurality of accordion pleats, as best illustrated in FIGS. 2 and 4. Each fold is about nine-sixteenths of an inch from the next adjacent fold. The front and back ends of each of the panels 42 and 44 form thin, narrow, elongated attachment strips 46 that are heat welded to the facing surfaces of the filing case back cover 47 and the filing case front cover 45, as best illustrated in the sectional detail view of FIG. 8. The strips 46 extend the entire length of the filing case side panel sheets 42 and 44 and are sealed throughout their lengths from near the bottom folds 64 and 68 to near the top edges 62 and 66 of the filing case front cover 45 and filing case back cover 47, respectively.

Figure 7:
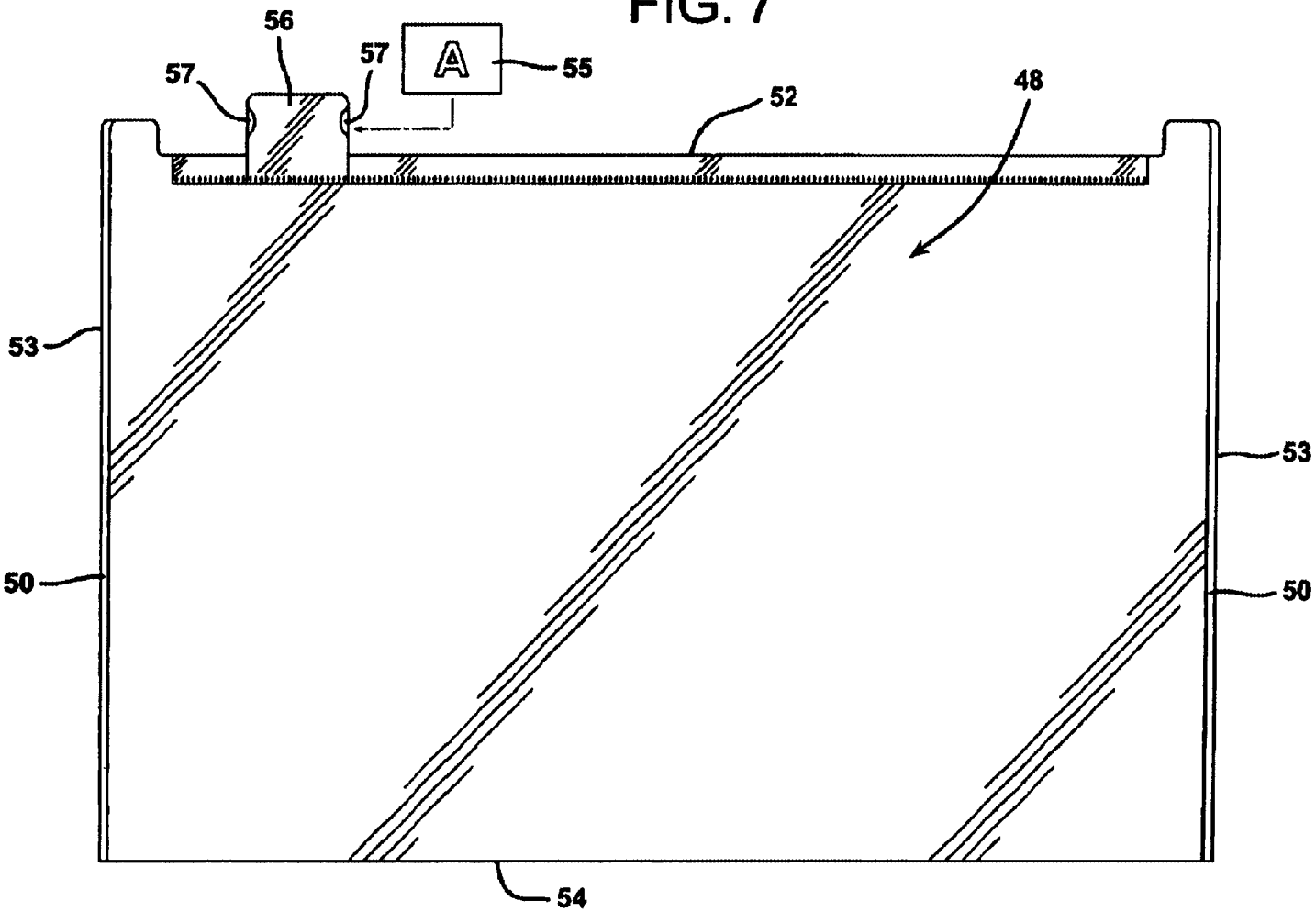
FIG. 7 is a rear elevational view illustrating a single one of the filing case dividers employed in the filing case illustrated in FIG. 2.
Figure 8:
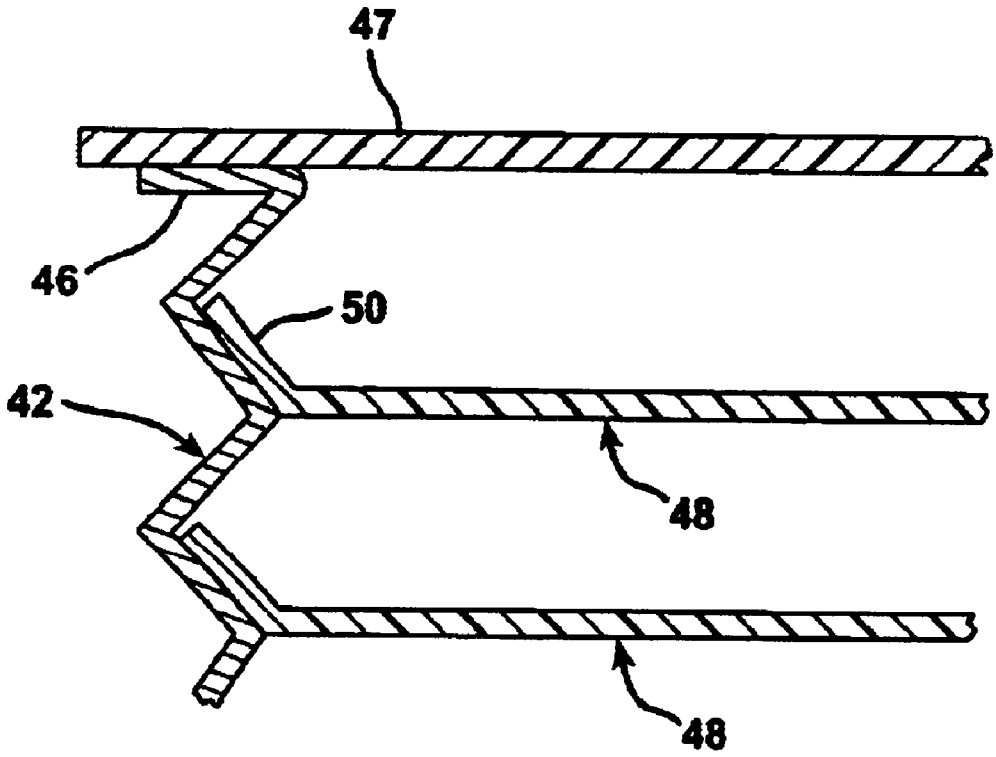
FIG. 8 is a sectional detail taken along the lines 8—8 in FIG. 2.

The filing case 14 is further comprised of file section dividers 48 that are each formed of a separate sheet of plastic. FIG. 5 shows a single one of the large file section divider sheets 48 in elevation and in isolation. As illustrated in FIGS. 5 and 8, each of the filing case section dividers 48 is folded at its transverse ends to form side edge margin strips 50, which are narrow, elongated strips and which extend the entire height of the filing case section dividers 48. Each filing case section divider 48 has a generally rectangular configuration with a horizontal top edge 52 and a horizontal bottom edge 54. The top and bottom edges 52 and 54 are mutually parallel to each other. The interior portion of the top edge 52 may be recessed downwardly below the transverse extremities of the divider sheet 48 and indexing label tabs 56 may be heat welded at different locations along the transverse width of the large file section dividers 48, as illustrated in FIGS. 2 and 7. Each filing case section divider 48 also has mutually parallel side edges 53 which are oriented perpendicular to the filing case divider upper and lower edges 52 and 54.

Each of the indexing tabs 56 is formed of a doubled over strip of plastic, the bottom edges of which are heat welded to the top of the filing case section dividers 48, as shown in FIG. 7. Small gripping notches 57 are provided at the opposing right edges of each tab 56 on one side thereof to facilitate separation of the two plies of plastic forming the tab 56 in order to insert thin paper labels 55 therein, as illustrated in FIG. 7. The file indexing tabs 56 thereby from a readily visible indexing system for the filing case 14, as is evident from FIGS. 2 and 6.

The side edge margins 50 of the filing case section dividers 48 are heat welded to the filing case side panel sheets 42 and 44 throughout between the upper and lower divider edges 52 and 54 of the filing case section dividers 48, as best illustrated in FIG. 8. The side edges 53 of the filing case section dividers 48 are thereby coupled to the filing case front cover 45 and the filing case back cover 47 with a plurality of accordion fold pleated connections formed by the filing case side panels 42 and 44. The opposing end margins 46 of the file case side panel sheets 42 and 44 are folded to reside in intimate contact with the mutually facing surfaces of the large front and back covers 18 and 20, and are sonic welded thereto from top to bottom, as illustrated in FIG. 8.

A major difference between the expandable filing case 14 and filing pouch 12 is in the size of the file pockets formed therein. More specifically, while the filing case section dividers 48, together with the accordion folded large side panels 42 and 44, form a plurality of file pockets in the filing pouch 12 having dimensions large enough to accommodate papers measuring 8.5 by 11 inches between the filing case section dividers 48 and the large front and back covers 18 and 20, the file pocket of filing pouch 12 is somewhat larger and much thicker.

In the embodiment of the wallet assembly 10 illustrated in FIGS. 1–6, the bottoms 54 of the filing case section dividers 48 are open and are not sealed to any other structure. However, the filing case bottom panel 39 forms a closure member between the file section dividers 48. In this way, papers inserted into the file pockets of the filing case 14 rest upon the bottom panel 39 thereof, but are separated by the filing case section dividers 48.

The first and second mutually engageable and releaseable fastening elements 16 and 17 are preferably formed of mating fabric hook and loop interengageable fastening patches. The first fastening elements 16 are mounted and permanently secured near the top and bottom of the filing case back cover 47 proximate the four corners thereof, as illustrated in FIG. 5. The rectangular fastening patches 16 each bear a multiplicity of minute stiff, but resilient plastic hooks. The second fastening elements 17 are likewise mounted and permanently secured near the top and bottom of the front cover 20 of the filing pouch 12 and are positioned near the corners thereof for registration with the fastening patches 16, as illustrated in FIG. 3. The second fastening patches 17 bear a fabric pile with which the minute hooks of the fastening patches 16 are releaseably engageable.

As is evident from FIG. 6, the filing case 14 may be releaseably attached to the filing pouch 12 merely by moving the filing case 14 toward the filing pouch 12 to press the filing case back cover 47 against the filing pouch front cover 20. The filing case 14 will thereby remain firmly attached to the filing pouch 12 until purposefully removed therefrom. In this position the filing pockets between the filing case file section dividers 48 may be easily accessed by pulling the top edge 62 of the filing case front cover 45 forward to expand the side panels 42 and 44 and allow easy access to papers in the file pockets between the filing case file section dividers 48 and the filing case front cover 45 and back cover 47.

The filing pouch 12 and the filing case 14 may alternatively be used independently of each other. To separate the filing case 14 from the filing pouch 12, a user merely pulls the filing case back cover 47 away from the filing pouch front cover 20 to disengage the fastening elements of the mutually engageable fastening patches 16 and 17. The filing case 14 may thereby be completely separated from the filing pouch 12, as illustrated in FIG. 6.

Figure 9:
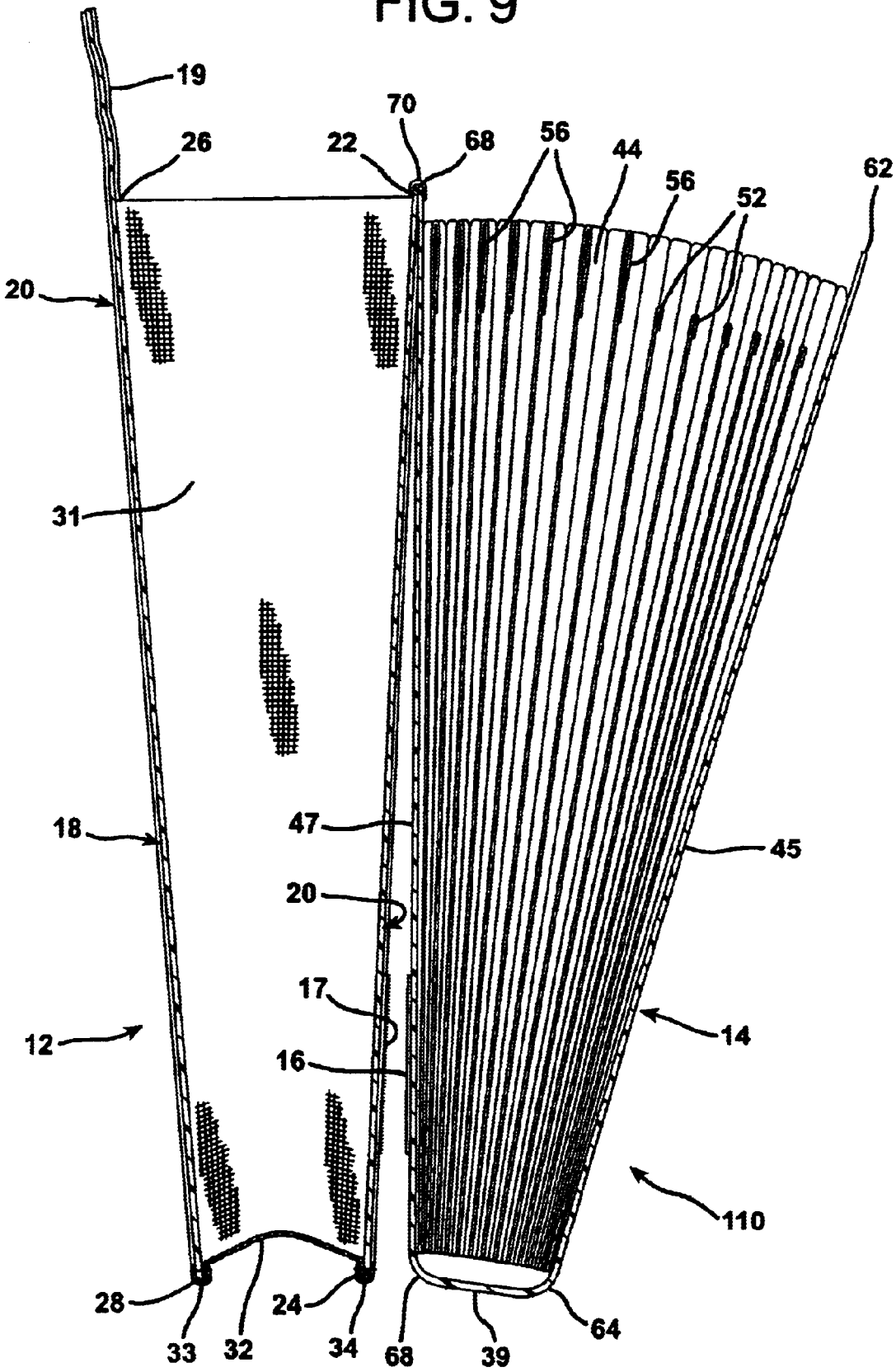
FIG. 9 is a side elevational sectional view illustrating an alternative embodiment of a portable document storage device according to the invention.

In some situations it may be desirable for the filing case 14 and filing pouch 12 to be permanently attached to each other. FIG. 9 is a cross-sectional view illustrating such an alternative embodiment of the portable document storage device of the invention. As seen in FIG. 9, the portable document storage device 110 also includes the same filing case 14 and filing pouch 12 as the portable document storage device 10 illustrated in drawing FIGS. 1 through 8. However, in the portable document storage device 110, the first fastening fabric patches 16 bearing a multiplicity of tiny hooks are located only at the bottom of the filing case back cover 47 of the filing case 14. The second fastening patches 17 bearing the loop pile are permanently attached to the pouch front cover 20 also only near the bottom 24 thereof for registration with the first fastening elements 16. The pouch front cover 20 and the filing case back cover 47 are permanently secured together at their respective tops 22 and 66 by stitching extending across the upper edges 22 and 66 of the filing pouch front panel 20 and filing case back panel 47. The stitching ends are concealed by U-shaped clips 70.

In the portable document storage device 110, the interengageable fastening elements 16 and 17 may be separated so that the bottoms 32 and 39 of the filing pouch 12 and filing case 14 may be moved a short distance apart to allow both the filing pouch 12 and the filing case 14 to stand upon a supporting surface therebeneath. However, when the filing case back cover 47 is pressed back against the filing pouch front cover 20, the flexible, fabric hook and loop fastening elements 16 and 17 near the lower edges 24 and 68 of the filing pouch front cover 20 and filing case back cover 47 are releaseably engaged with each other. This releaseable interconnection allows the filing case 14 and the filing pouch 12 to be carried together as a unit, with the filing pouch closure flap 15 enveloping the filing case 14, in the manner illustrated in FIG. 1.

Undoubtedly, numerous variations and modifications of the invention will become readily apparent to those familiar with portable document storage devices. For example, snap fasteners or other types of mutually engageable and releaseable fastening devices may be utilized in place of the fabric hook and the fastening strips 16 and 17. Also, the top edge of either the pouch front cover or the filing case back cover can be formed with an extended lip, turned over to face the opposing cover. Fasteners, such as Velcro® strips, stitching, or a sonic weld can be used to secure the turned over lip to the opposing cover. Accordingly, the scope of the invention should not be construed as limited to this specific embodiments depicted and described, but rather is defined in the claims appended hereto.

I claim:

1. In combination, a filing wallet having a pouch front cover and a pouch back cover both having a top and a bottom, and a pouch folding flap joined to said top of said pouch back cover in articulated fashion, whereby said pouch folding flap is foldable over said top of said pouch front cover and unfoldable to expose said top of said pouch front cover, a pair of pouch side panels each having a top and a bottom and each being attached to said pouch front and pouch back covers from said tops to said bottoms thereof, and a pouch bottom panel extending transversely between said pouch side panels and between said pouch front and back covers, whereby said filing wallet forms a pouch file pocket between said pouch front and pouch back covers, said pair of pouch side panels and said pouch bottom panel, and an expandable filing case having a filing case front cover and a filing case back cover both having a top and a bottom and said filing case back cover is connected to said pouch front cover, and said filing case has a plurality of filing case file section dividers having opposing mutually parallel, upper and lower filing case divider edges and opposing, mutually parallel filing case divider side edges oriented perpendicular to said upper and lower filing case divider edges, and a pair of filing case side panel sheets coupled to said filing case front and back covers and folded from top to bottom with a plurality of accordion folds, and wherein said filing case file section dividers are formed of filing case divider sheets having side edge margins at said divider side edges that are individually secured to said filing case side panel sheets at separate ones of said accordion folds, and wherein both said filing case side panel sheets and said filing case file section dividers are formed of sheets of plastic, and said side edge margins of said filing case file section dividers are heat welded to said filing case side panel sheets throughout between said upper and lower divider edges of said filing case file section dividers, and said bottom edges of said of filing case file section dividers are closed, thereby forming a plurality of filing case file pockets between said filing case file section dividers and said filing case front and filing case back covers, and wherein said filing wallet foldable flap is foldable over said filing case to both close said pouch file pocket and envelop said filing case between said filing wallet foldable flap and said filing wallet front cover.

2. A combination according to claim 1 wherein said filing case front and back covers are formed of a single, stiff sheet of covering material that is folded to delineate said filing case front and back covers, and which is folded further to delineate a filing case bottom panel between said filing case front and back covers and said filing case bottom panel thereby forms a closure member beneath said filing case file section dividers.

3. A combination according to claim 1 wherein releaseable fastening members are provided including mutually engageable first and second fastening member elements for connecting said filing case back cover to said filing pouch front cover, and said first fastening member elements for connecting said filing case back cover to said pouch front cover, are permanently secured to said filing case back cover and said second fastening member elements are permanently secured to said pouch front cover.

4. A combination according to claim 3 wherein said mutually engageable first and second fastening member elements are comprised of flexible fabric hook and loop fastening members.

5. A combination according to claim 1 wherein said pouch front cover and said filing case back cover are permanently secured together across their tops.

6. A combination according to claim 5 further comprising first and second mutually engageable and releaseable fastening elements, and said first releaseable fastening elements are permanently secured to said bottom of said filing case back cover and said second releaseable fastening elements are permanently secured to said bottom of said filing wallet front cover for registration and engagement with said first releaseable fastening elements.

7. A combination according to claim 1 wherein said pouch back cover and said pouch folding flap are formed of a first sheet of stiff plastic and said pouch front cover is formed of a second sheet of stiff plastic, and said pouch side panels and said pouch bottom panels are formed of a single strip of flexible fabric that has opposing edge margins which contact said pouch front and back covers and are permanently secured thereto.

8. A portable document storage device including:

a portable file folder pouch formed of a pouch file base sheet upon which a pouch back file cover and a foldable pouch file flap are delineated, a pouch front cover, and pouch side panels and a pouch bottom panel disposed between said pouch front and back covers and joined to said pouch front and back covers, a filing case formed of a plastic case base sheet upon which are delineated a case back cover having upper and lower edges, a case bottom, and a case front cover having upper and lower edges, a plurality of plastic filing case file section divider sheets having opposing, mutually parallel filing case divider side edges at which side edge margins are formed, a pair of plastic filing case side panel sheets that are folded from top to bottom with a plurality of accordion pleats, and wherein said filing case divider sheet side edge margins are individually secured to said filing case side panel sheets by heat sealing at separate ones of said accordion pleats therein, thereby forming a plurality of filing case file pockets between said filing case file section divider sheets and said filing case front and filing case back covers, and detachable fasteners on said pouch front cover and on said filing case back cover releaseably joining said portable file folder pouch and said filing case together.

9. A portable document storage device according to claim 8 wherein said pouch front file cover and pouch back file cover and said pouch folding flap are formed of sheets of stiff plastic and said pouch side panels and said pouch bottom panel are formed of a single, elongated fabric strip have opposing edge margins which are folded to reside in contact with said pouch front file and pouch back file covers and are permanently secured thereto from top to bottom.

10. A portable document storage device according to claim 8 wherein said pouch back file cover and said pouch file flap are both formed by a delineating fold as sections of said pouch file base sheet and said pouch front cover is formed by a separate front sheet and further comprising an elongated fabric strip forming said pouch side panels and said pouch bottom panel.

11. A portable document storage device according to claim 8 wherein said detachable fasteners each include first and second mutually engageable and releaseable fastening elements and said first fastening elements are located at said bottom of said filing case back cover and said second fastening elements are located at said bottom of said pouch front cover for registration with said first fastening elements, and said pouch front file cover and said filing case back cover are permanently secured together at their tops.

12. A wallet assembly comprising:

a filing pouch formed of a first base sheet folded to define a filing pouch back cover having top, bottom, and opposing sides and a filing pouch cover flap joined to said filing pouch back cover at said top thereof, a filing pouch front cover having top, bottom, and opposing sides, opposing filing pouch side panels and a filing pouch bottom panel located therebetween, a filing case formed of a plastic filing case base sheet folded to define a filing case back cover having top, bottom, and opposing sides, a filing case bottom panel and a filing case front cover having a top, bottom, and opposing sides, and opposing filing case side panels each formed as a plastic sheet and each having opposing side edge attachment strips folded from top to bottom and joined to said sides of said filing case front and back covers by heat welding and plastic filing case file dividers having side edge margins and located between said filing case front and back covers and said opposing filing case side panels are folded to form a plurality of accordion pleats therein to permit said filing case front and back covers to be collapsed toward each other and expanded away from each other, and said filing case file divider side edge margins are fastened to said filing case side panels by heat welding at separate ones of said accordion pleats in said filing case side panels, thereby creating a plurality of separate file pockets between said filing case front and back covers, and releaseably engageable fasteners located on said filing pouch front cover and said filing case back cover for detachably coupling said filing case back cover and said filing pouch front cover into a mutually facing disposition and in contact throughout.

13. A wallet assembly according to claim 12 wherein said filing case back cover and said filing pouch front cover are hinged together at their tops and said releaseable fasteners are located at said bottoms of said filing case back cover and said filing pouch front cover.

14. A wallet assembly according to claim 12 wherein said filing pouch and said filing case are completely detachable one from another and alternatively are releaseably engageable one with another so that said filing case back cover is releaseably engaged with said filing pouch front cover and said filing pouch cover flap is foldable over said filing case.

* * * * *